US011540970B2

(12) United States Patent
Chen

(10) Patent No.: US 11,540,970 B2
(45) Date of Patent: Jan. 3, 2023

(54) MAT TRANSMISSION STRUCTURE

(71) Applicant: Wen-Deng Chen, Erlin Township, Changhua County (TW)

(72) Inventor: Wen-Deng Chen, Erlin Township, Changhua County (TW)

( * ) Notice: Subject to any disclaimer, the term of this patent is extended or adjusted under 35 U.S.C. 154(b) by 308 days.

(21) Appl. No.: 17/004,611

(22) Filed: Aug. 27, 2020

(65) Prior Publication Data

US 2022/0062094 A1 Mar. 3, 2022

(51) Int. Cl.
*A61H 15/00* (2006.01)
*A61H 7/00* (2006.01)

(52) U.S. Cl.
CPC ..... *A61H 15/0078* (2013.01); *A61H 7/007* (2013.01); *A61H 2015/0021* (2013.01); *A61H 2201/1215* (2013.01); *A61H 2201/14* (2013.01)

(58) Field of Classification Search
CPC ..... A61H 15/0078; A61H 7/007; A61H 2015/0021; A61H 2201/1215; A61H 2201/14; A61H 23/0254; A61H 23/006; A61H 2201/0134; A61H 2201/0142; A61H 2201/1418; A61H 2201/149; A61H 2201/5002; A61H 2201/0138; A61H 2201/0146
See application file for complete search history.

(56) References Cited

U.S. PATENT DOCUMENTS 2,773,498 A * 12/1956 Himmelman ..... 5/934
3,298,363 A * 1/1967 Parkin ..... A61H 1/008 5/934
4,947,832 A * 8/1990 Blitzer ..... A61H 23/0254 601/56
5,092,315 A * 3/1992 Bennett ..... A61H 1/00 601/93
8,863,338 B2 * 10/2014 Dzioba ..... A61G 7/05776 601/149

FOREIGN PATENT DOCUMENTS

TW M580961 U 7/2019

* cited by examiner

*Primary Examiner* — Justine Ryu
*Assistant Examiner* — Matthew R Moon
(74) *Attorney, Agent, or Firm* — Alan D. Kamrath; Karin L. Williams; Mayer & Williams PC

(57) ABSTRACT

A mat transmission structure includes a first body, multiple first operation units, and a power unit. The first body is provided with a first recess and multiple first pivot portions. Each of the first operation units is pivotally mounted on each of the first pivot portions. Each of the first operation units includes a rod, multiple first operation members, and a first driving member. The rod is provided with a first fitting portion, two first pivoting sections, and a first mounting portion. Each of the first operation members is provided with a first surface and a second fitting portion. The first driving member is mounted on the first mounting portion. The power unit drives the first driving member of each of the first operation units such that each of the first operation units is rotated in the first recess.

13 Claims, 18 Drawing Sheets

MAT TRANSMISSION STRUCTURE

BACKGROUND OF THE INVENTION

1. Field of the Invention

The present invention relates to a massaging apparatus and, more particularly, to a mat (or pad) transmission structure.

2. Description of the Related Art

A conventional massaging structure was disclosed in the Taiwanese Patent Publication No. M580961, and comprises two massaging rollers 10, base 20, a massaging roller motor 33, a swinging motor 34, and a swinging arm 30. Each of the two massaging rollers 10 includes two circular disks 11 and multiple massaging units 12 mounted between the two circular disks 11. Each of the two circular disks 11 has multiple through holes 112. A shaft 111 is connected between the two circular disks 11. Each of the massaging units 12 includes an elastic thread 121 and multiple massaging balls 122. The elastic thread 121 extends through the massaging balls 122 and is secured to each of the through holes 112 of each of the two circular disks 11 such that each of the massaging units 12 is mounted between the two circular disks 11.

The conventional massaging structure has the following disadvantages.

1. When the massaging roller motor 33 and the swinging motor 34 are started, each of the massaging units 12 is driven and rotated by the massaging roller motor 33, and the swinging arm 30 is driven and moved by the swinging motor 34, such that the two massaging rollers 10 are moved to massage the user's lower body. However, the conventional massaging structure is not expandable and cannot be used to massage the other part of the user.

2. The two massaging rollers 10 are mounted on the two sides of the massaging end 31. The swinging arm 30 has a determined weight to support the two massaging rollers 10 such that the two massaging rollers 10 can be rotated relative to the base 20. In addition, the massaging roller motor 33 and the swinging motor 34 are mounted in the swinging arm 30 to increase the weight of the swinging arm 30. Further, the two massaging rollers 10 and the swinging arm 30 are mounted on the base 20 to increase the volume and weight of the base 20. Thus, the conventional massaging structure is heavy and is not carried easily.

BRIEF SUMMARY OF THE INVENTION

The primary objective of the present invention is to provide a mat transmission structure that is expandable and is placed on any plane to provide a massaging effect to any part of the user's body.

In accordance with the present invention, there is provided a mat transmission structure comprising a first body, a plurality of first operation units, and a power unit. The first body is provided with a first recess and a plurality of first pivot portions. The first operation units are pivotally mounted in the first recess. Each of the first operation units is pivotally mounted on each of the first pivot portions. The first operation units are rotated simultaneously in the first recess. Each of the first operation units includes a rod, a plurality of first operation members, and a first driving member. The rod is provided with a first fitting portion, two first pivoting sections, and a first mounting portion. Each of the first operation members is provided with a first surface and a second fitting portion. The first driving member is mounted on the first mounting portion. The power unit drives the first driving member of each of the first operation units such that each of the first operation units is rotated in the first recess.

According to the primary advantage of the present invention, the mat transmission structure is placed on any plane. Thus, when any part of the user's body rests on the mat transmission structure, the mat transmission structure provides a patting and massaging effect to the user. The mat transmission structure is expandable, and multiple mat transmission structures are provided and arranged linearly to provide a massaging effect to more parts of the user's body.

According to another advantage of the present invention, the eccentric construction is defined between the second fitting portion and each of the first operation members, such that the first surface of each of the first operation members has a height variation when the rod and the first operation members are rotated. Thus, the first operation members of each of the first operation units are mounted at the same angle or at different angles such that when each of the first operation units is rotated, the first surfaces of the first operation units are flush or not flush with each other. In such a manner, the second surfaces of the second operation units are driven by the first operation units and in turn moved to press and massage the user's body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
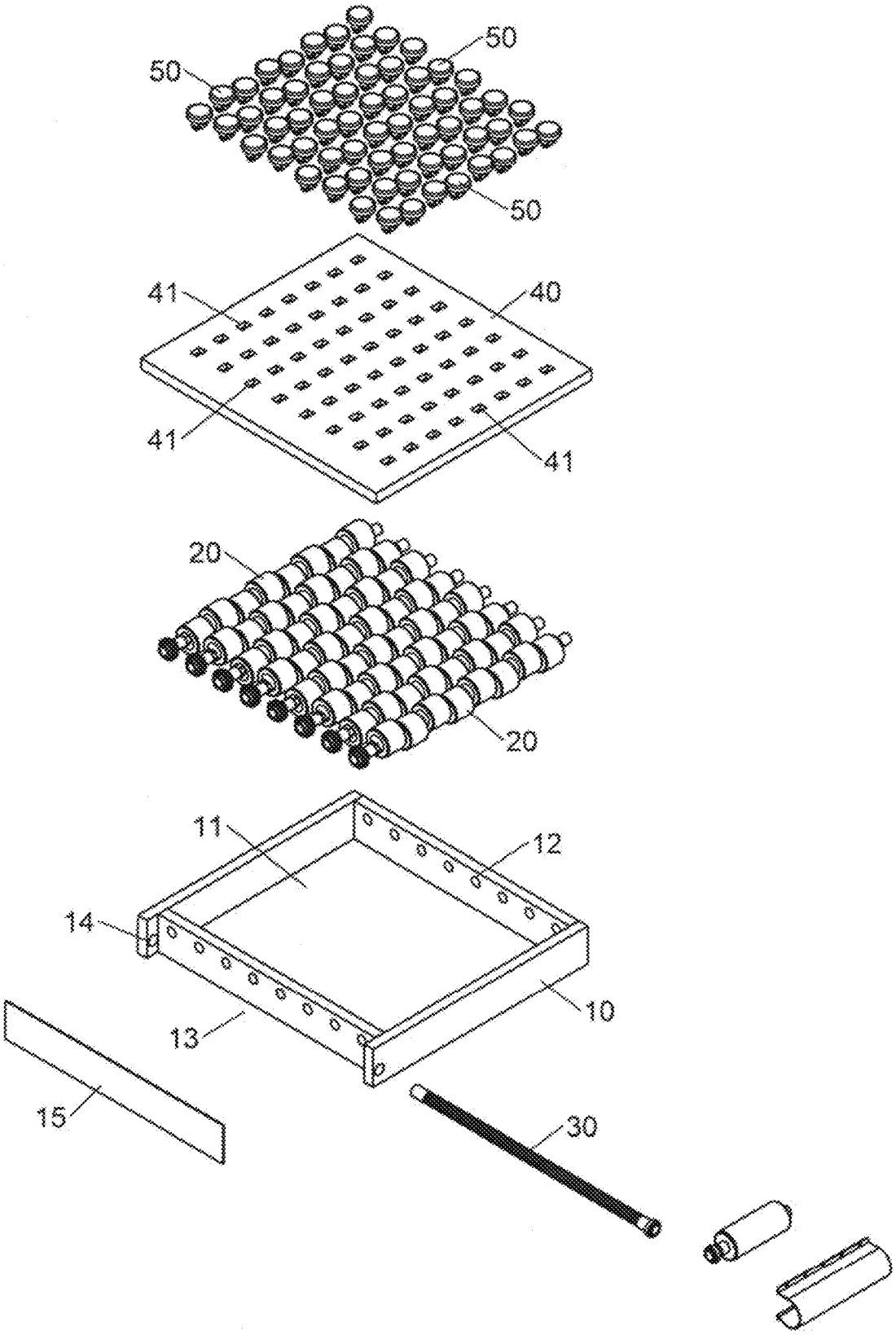
FIG. 1 is an exploded perspective view of a mat transmission structure in accordance with the preferred embodiment of the present invention.
Figures 2, 3:
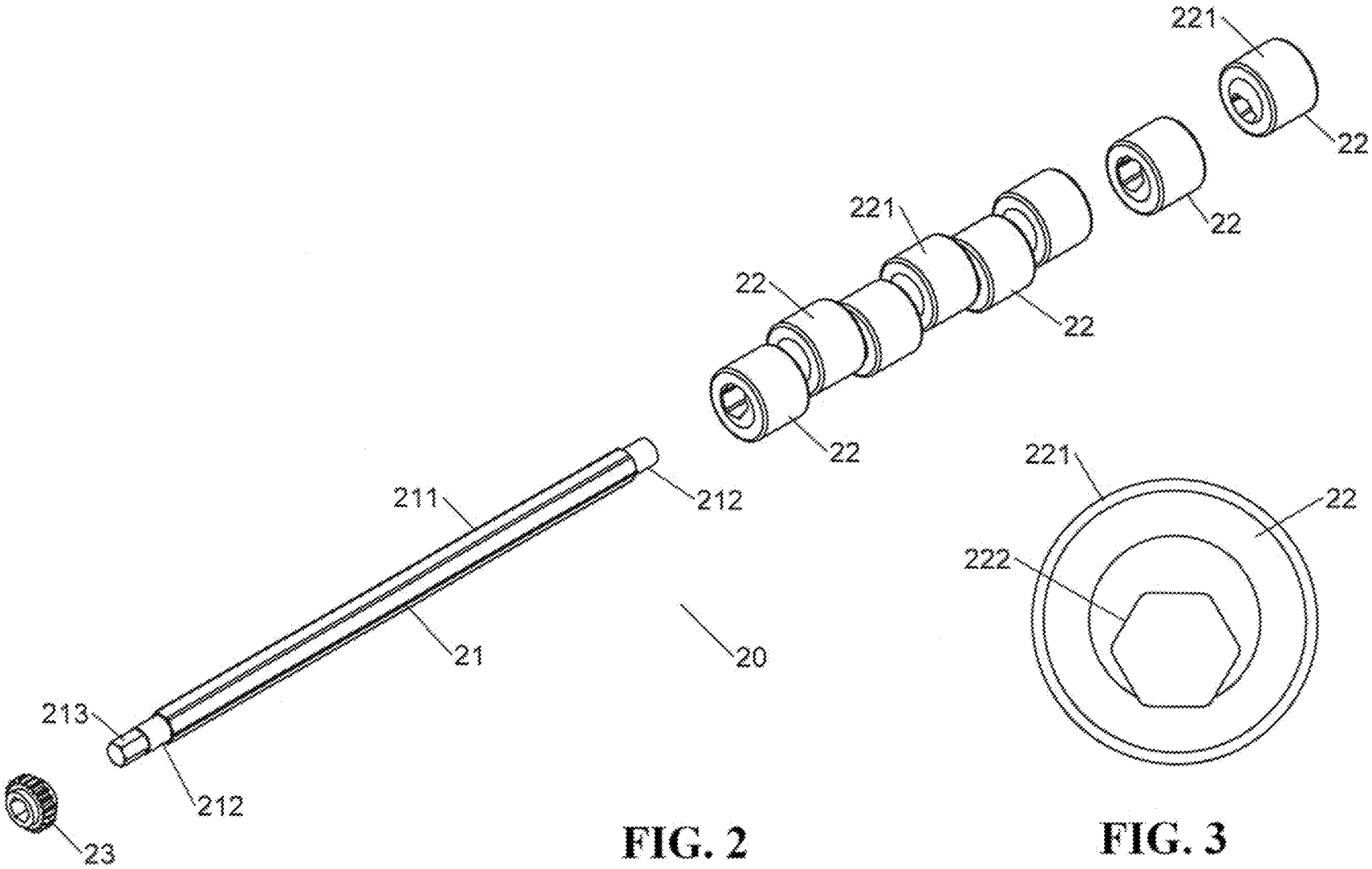
FIG. 2 is an exploded perspective view of a first operation unit of the mat transmission structure in accordance with the preferred embodiment of the present invention.
FIG. 3 is a front view of a first operation member of the first operation unit in accordance with the preferred embodiment of the present invention.
Figure 4:
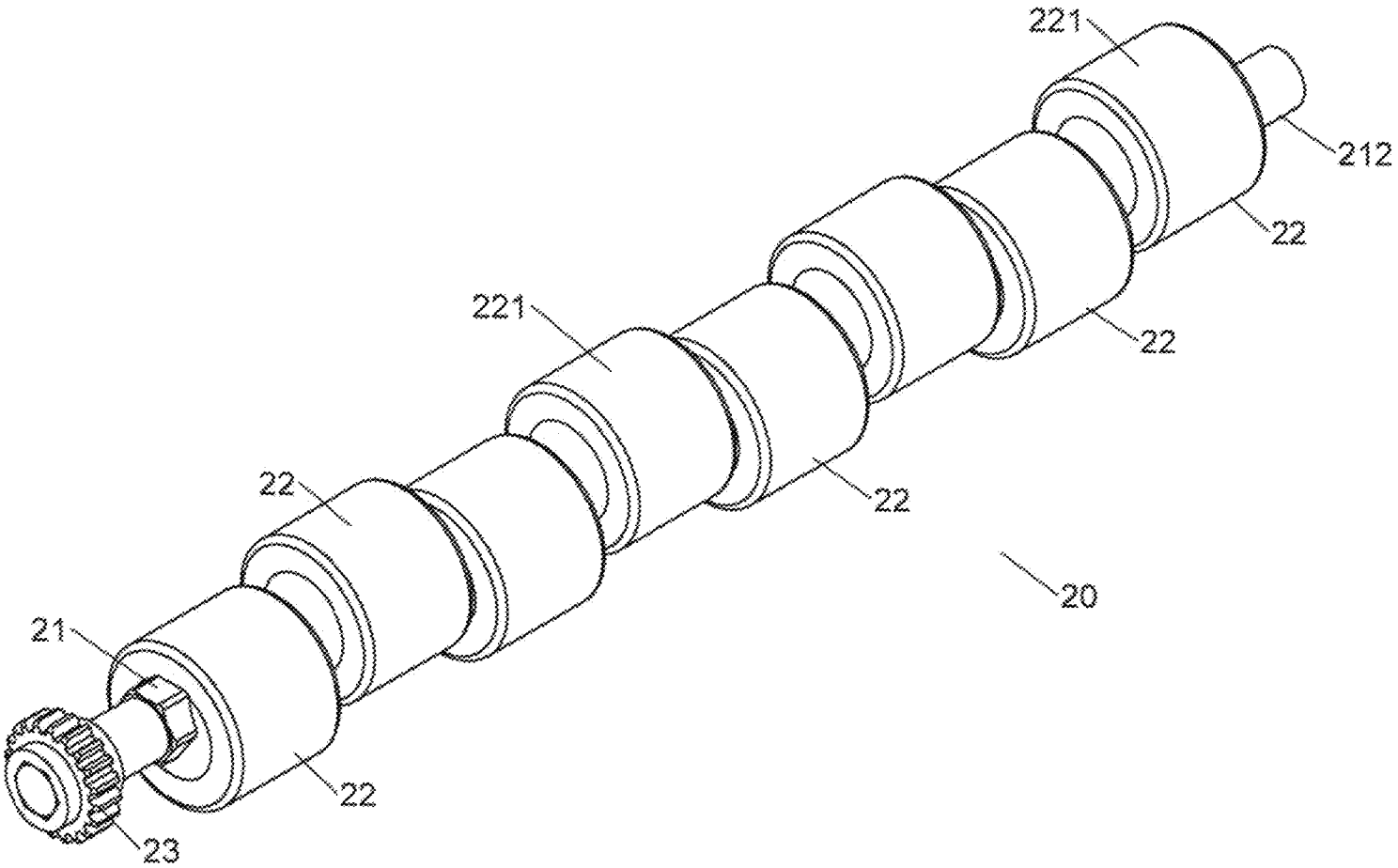
FIG. 4 is a perspective assembly view of the first operation unit of the mat transmission structure in accordance with the preferred embodiment of the present invention.
Figure 5:
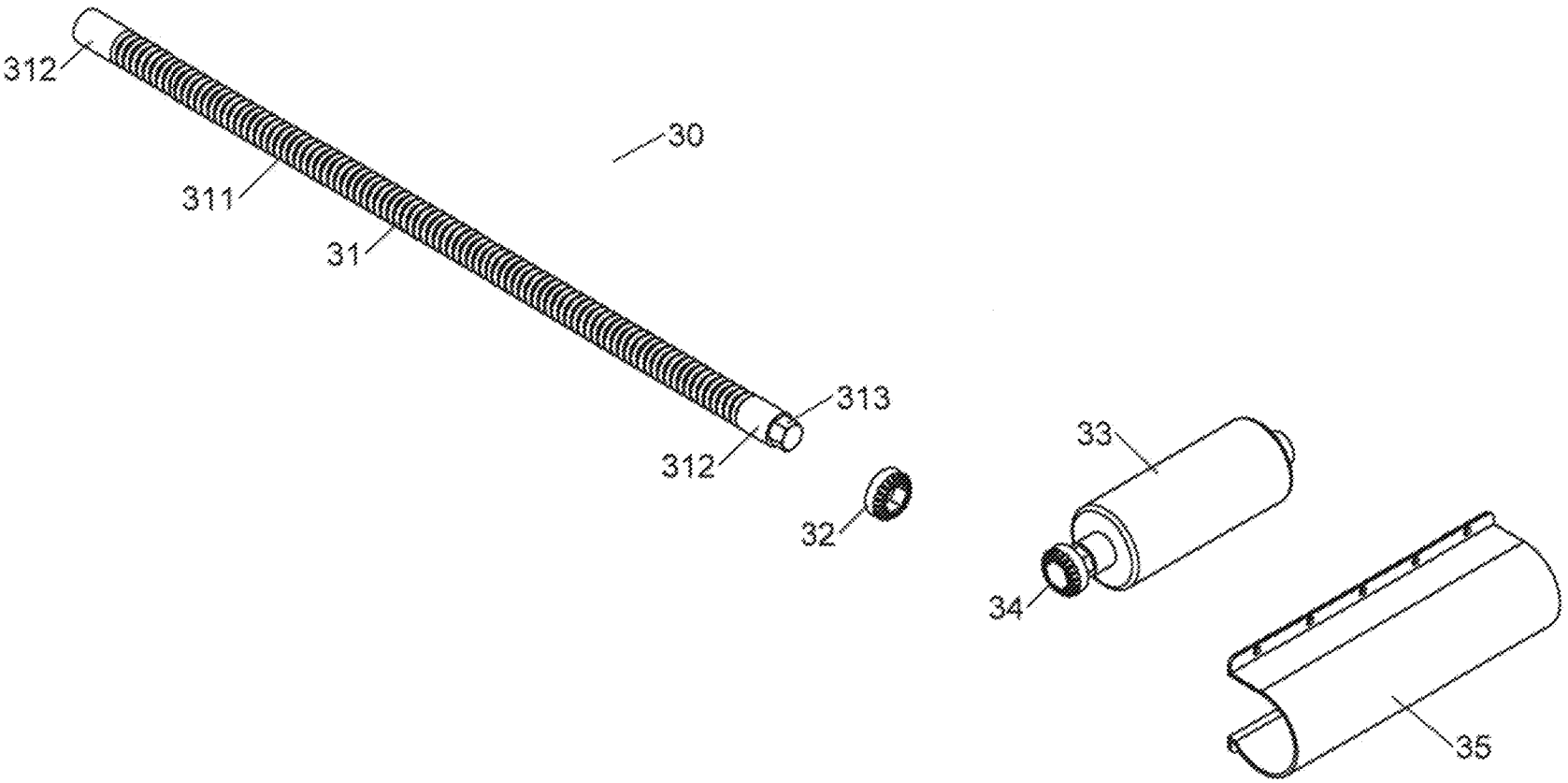
FIG. 5 is an exploded perspective view of a power unit of the mat transmission structure in accordance with the preferred embodiment of the present invention.
Figure 6:
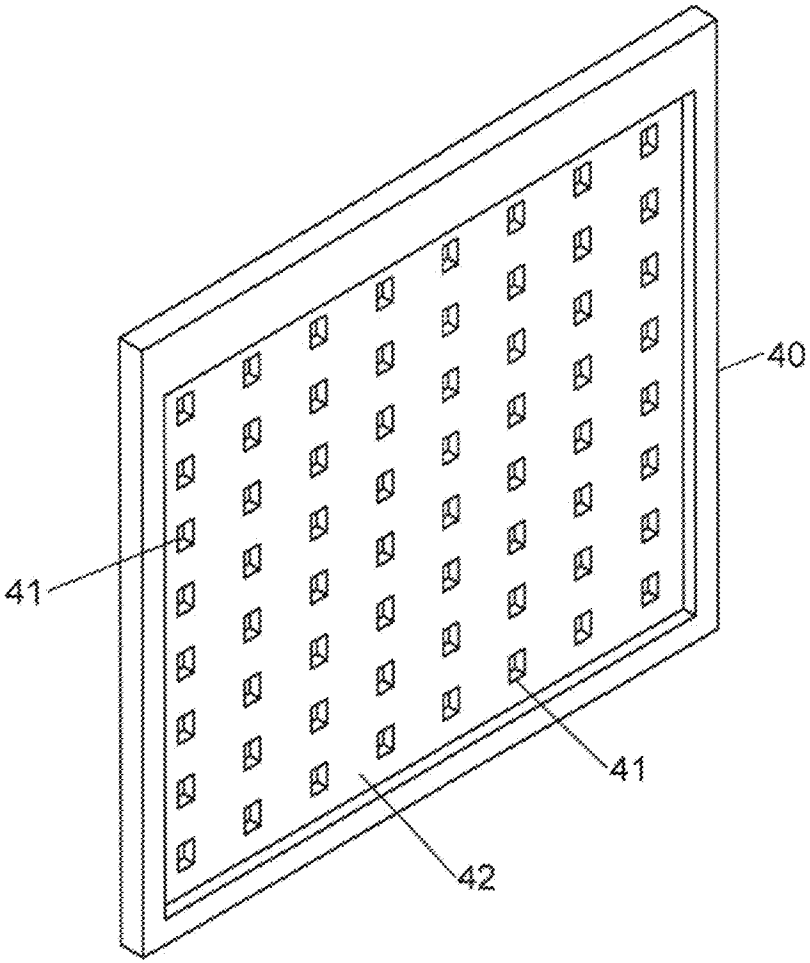
FIG. 6 is a perspective view of a second body of the mat transmission structure in accordance with the preferred embodiment of the present invention.
Figure 7:
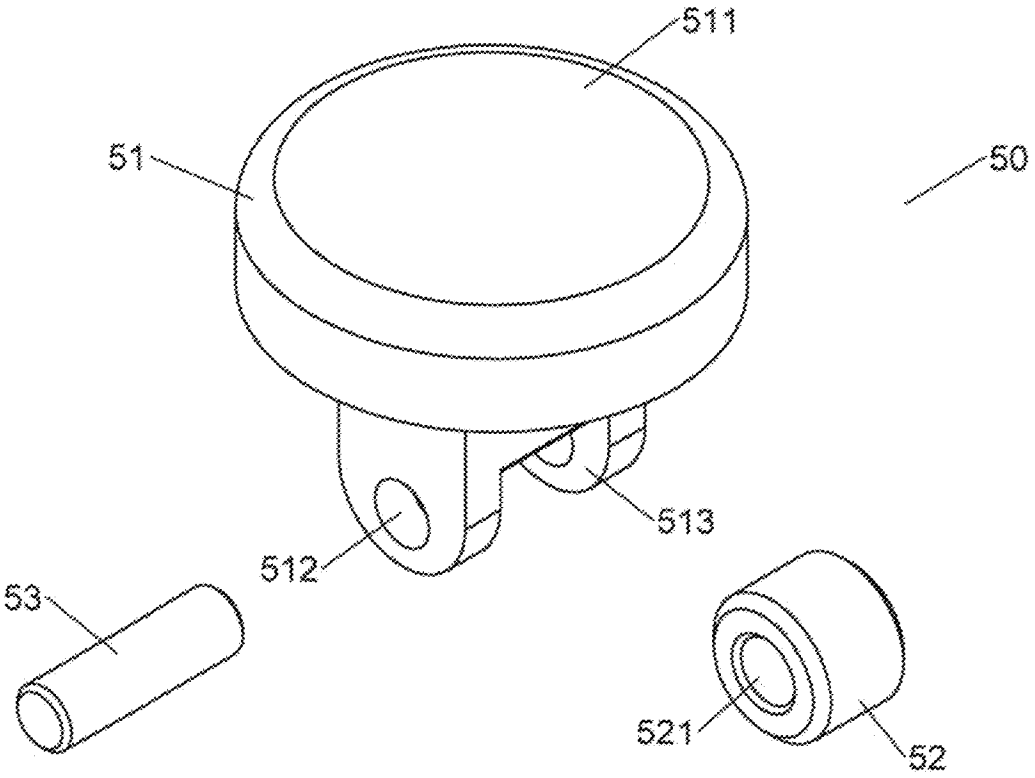
FIG. 7 is an exploded perspective view of a second operation unit of the mat transmission structure in accordance with the preferred embodiment of the present invention.

Referring to the drawings and initially to FIGS. 1-10, a mat transmission structure in accordance with the preferred embodiment of the present invention comprises a first body 10, a closure (or closing) board 15, a plurality of first operation units 20, a power unit 30, a second body 40, and a plurality of second operation units 50.

The first body 10 is a quadrilateral frame (or rack) assembled by a plurality of boards (or plates). The first body 10 is provided with a first recess 11. The first recess 11 has a quadrilateral shape and has an open top and an open bottom. The first recess 11 is provided with a plurality of first pivot portions 12 which are connected to the first recess 11. The first pivot portions 12 are arranged linearly and spaced from each other. Each of the first pivot portions 12 is a circular perforation extending transversely through the first recess 11. The first body 10 has a side provided with a second recess 13 connected to the first pivot portions 12. The second recess 13 is open and has a rectangular shape. The second recess 13 is provided with a second pivot portion 14 which is connected to the second recess 13. The second pivot portion 14 is a circular perforation extending longitudinally through the second recess 13. The second pivot portion 14 has an axis perpendicular to that of each of the first pivot portions 12.

The closure board 15 closes (or seals) a side of the second recess 13 such that the side of the second recess 13 is closed. The closure board 15 aligns with the first pivot portions 12.

The first operation units 20 are pivotally mounted in the first recess 11. Each of the first operation units 20 is pivotally mounted on each of the first pivot portions 12, and rotated about an axis thereof through three hundred and sixty degrees (360°). The first operation units 20 are arranged linearly, and rotated simultaneously in the first recess 11. Each of the first operation units 20 includes a rod (or driven shaft) 21, a plurality of first operation members 22, and a first driving member 23.

The rod 21 is mounted pivotally on each of the first pivot portions 12, and rotated about each of the first pivot portions 12 through three hundred and sixty degrees (360°). The rod 21 has a length corresponding to that of the first body 10. The rod 21 is provided with a first fitting portion 211. The first fitting portion 211 has two ends each provided with a first pivoting section 212. The first pivoting section 212 is pivotally mounted on each of the first pivot portions 12, such that the rod 21 is pivotally connected with each of the first pivot portions 12. The rod 21 is provided with a first mounting portion 213 located beside the respective first pivoting section 212. The first mounting portion 213 protrudes from each of the first pivot portions 12 and extends into the second recess 13. Each of the first pivot portions 12 is arranged between the first fitting portion 211 and the first mounting portion 213.

The first operation members 22 are mounted on the rod 21 and received in the first recess 11. The first operation members 22 are arranged linearly on the rod 21 and spaced from each other. When the rod 21 is rotated, the first operation members 22 are rotated in concert with the rod 21. Each of the first operation members 22 has a periphery provided with a first surface 221. Each of the first operation members 22 is provided with a second fitting portion 222 fitted on the first fitting portion 211. An eccentric construction (or means) is defined between the second fitting portion 222 and each of the first operation members 22, such that the first surface 221 of each of the first operation members 22 has a height variation when the rod 21 and the first operation members 22 are rotated. The first surface 221 partially protrudes from a top of the first body 10 at a determined rotation angle of each of the first operation members 22 during rotation of each of the first operation members 22.

The first driving member 23 is mounted on the first mounting portion 213 and received in the second recess 13 of the first body 10.

The power unit 30 is assembled with the first body 10. The power unit 30 drives the first driving member 23 of each of the first operation units 20 to rotate through three hundred and sixty degrees (360°), such that each of the first operation units 20 is rotated in the first recess 11 through three hundred and sixty degrees (360°). The power unit 30 includes a drive shaft 31, a second driving member 32, a power mechanism 33, and a third driving member 34. The drive shaft 31 is received in the second recess 13 and provided with a drive portion 311 engaging the first driving member 23 of each of the first operation units 20. The drive portion 311 directly drives and rotates the first driving member 23 of each of the first operation units 20 such that each of the first operation units 20 is rotated through three hundred and sixty degrees (360°). The drive portion 311 is an external thread and has two ends each provided with a second pivoting section 312. The second pivoting section 312 is mounted pivotally on the second pivot portion 14, such that the drive shaft 31 is connected pivotally with the second pivot portion 14. The drive shaft 31 is provided with a second mounting portion 313 located beside the respective second pivoting section 312. The second mounting portion 313 protrudes from the first body 10.

The second driving member 32 is mounted on the second mounting portion 313 and protrudes from the first body 10.

The power mechanism 33 is arranged at a side of the second driving member 32 and protrudes from the first body 10. The power mechanism 33 includes a motor and a speed reduction unit.

The third driving member 34 is mounted on an end of the power mechanism 33 and engages the second driving member 32. The power mechanism 33 drives and rotates the third driving member 34 which drives and rotates the second driving member 32 which drives and rotates the drive shaft 31, and the drive portion 311 drives and rotates the first driving member 23 of each of the first operation units 20 such that each of the first operation units 20 is rotated.

The second body 40 is mounted on the top of the first body 10 and closes the first recess 11 and the top of the second recess 13, such that the first operation units 20 are hidden in the first body 10 and the second body 40. The second body 40 is provided with a plurality of first receiving portions 41. The first receiving portions 41 are arranged longitudinally and transversely and spaced from each other. Each of the first receiving portions 41 aligns with the first surface 221 of each of the first operation members 22. The second body 40 is provided with a third recess 42 aligning with the first recess 11 and receiving the first operation members 22. The third recess 42 has a quadrilateral shape and is connected to each of the first receiving portions 41.

The second operation units 50 are assembled with the first operation units 20 and the second body 40. Each of the second operation units 50 is mounted on each of the first receiving portions 41. The first operation units 20 are rotated and drive the second operation units 50 to move upward and downward. Each of the second operation units 50 includes a second operation member 51, a fourth driving member 52, and a pivot pin 53.

The second operation member 51 is received in each of the first receiving portions 41 and has a first end provided with a second surface 511 and a second end provided with a second receiving portion 513. The second surface 511 protrudes from the second body 40. The second receiving portion 513 is received in each of the first receiving portions 41 and extends into the third recess 42. The second receiving portion 513 is provided with a first pivot hole 512. The first pivot hole 512 is hidden in the second body 40 and spaced from the second surface 511. The first pivot hole 512 has a circular shape and extends transversely through the second receiving portion 513.

The fourth driving member 52 is mounted in the second receiving portion 513 and presses the first surface 221. A pivot construction (or means) is defined between the fourth driving member 52 and the second operation member 51. The power unit 30 drives and rotates each of the first operation units 20, and each of the first operation units 20 drives the fourth driving member 52 and the second receiving portion 513 to move upward and downward in each of the first receiving portions 41, such that the second surface 511 is moved upward and downward. Thus, when the use's body rests on the second surface 511, the second operation member 51 provides a patting (or hitting) and massaging effect to the user. The fourth driving member 52 has a cylindrical shape and is provided with a second pivot hole 521 which perforates the fourth driving member 52. The second pivot hole 521 aligns with the first pivot hole 512.

The pivot pin 53 is a circular rod and is pivotally mounted in the first pivot hole 512 and the second pivot hole 521, such that the fourth driving member 52 and the second operation member 51 are connected pivotally. The fourth driving member 52 is rotated about the pivot pin 53, and is rotated relative to each of the first operation members 22 in the second receiving portion 513.

In the preferred embodiment of the present invention, the first fitting portion 211 has a noncircular or hexagonal shape, the first pivoting section 212 has a circular shape, the first mounting portion 213 has a noncircular or hexagonal shape, the second fitting portion 222 has a shape corresponding to that of the first fitting portion 211, and the second fitting portion 222 is a hexagonal groove.

In the preferred embodiment of the present invention, each of the first operation members 22 has a cylindrical shape.

In the preferred embodiment of the present invention, the first operation members 22 of each of the first operation units 20 are mounted at different angles such that the first surfaces 221 of the first operation members 22 are not flush with each other, or mounted at the same angle such that the first surfaces 221 of the first operation members 22 are flush with each other. The first operation members 22 of one of the first operation units 20 and the first operation members 22 of another one of the first operation units 20 are mounted at different angles such that the first surface 221 of one of the first operation units 20 is not flush with the first surface 221 of another one of the first operation units 20.

In the preferred embodiment of the present invention, the first driving member 23 is a gear.

In the preferred embodiment of the present invention, the second pivoting section 312 has a circular shape, the second mounting portion 313 has a noncircular or hexagonal shape, the second driving member 32 is a gear, and the third driving member 34 is a gear.

In the preferred embodiment of the present invention, the power unit 30 further includes a cover 35 mounted on the first body 10 and having a C-shaped configuration. The second mounting portion 313, the second driving member 32, the power mechanism 33, and the third driving member 34 are hidden in the cover 35.

In the preferred embodiment of the present invention, each of the first receiving portions 41 is a quadrilateral groove.

Figure 8:
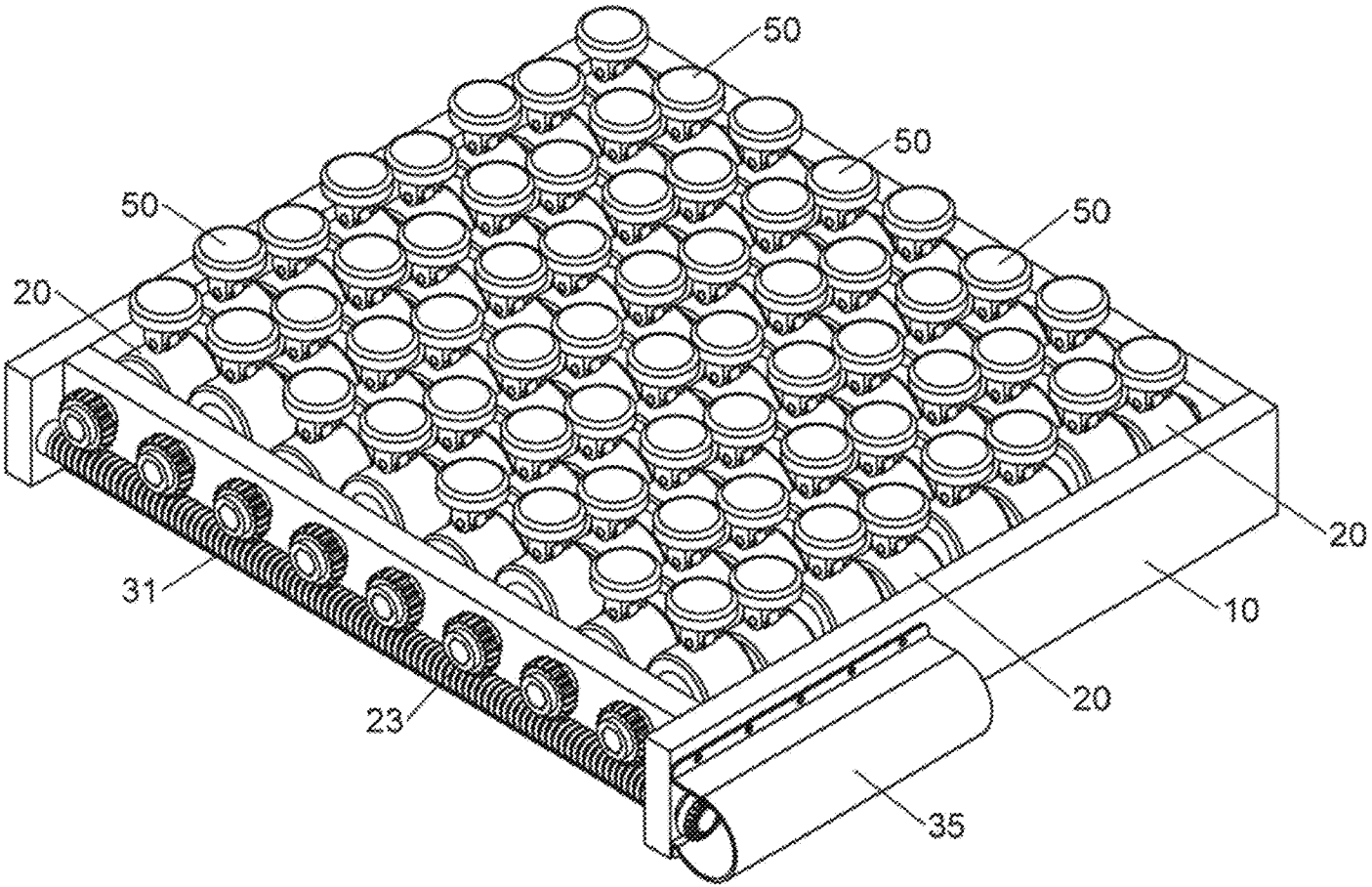
FIG. 8 is a partial perspective assembly view of the mat transmission structure in accordance with the preferred embodiment of the present invention.
Figure 9:
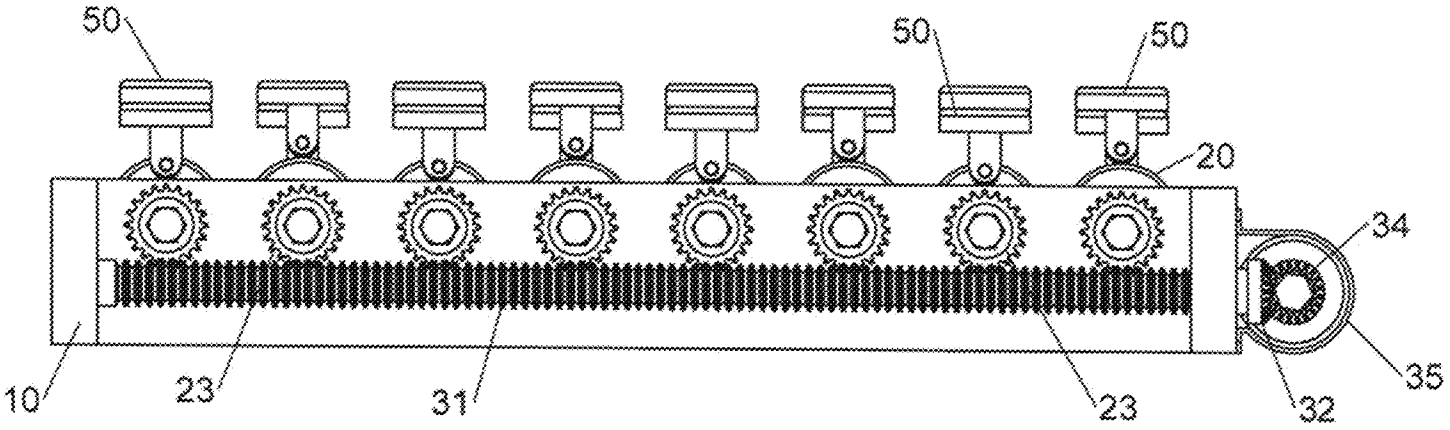
FIG. 9 is a front view of the mat transmission structure as shown in FIG. 8.
Figure 10:
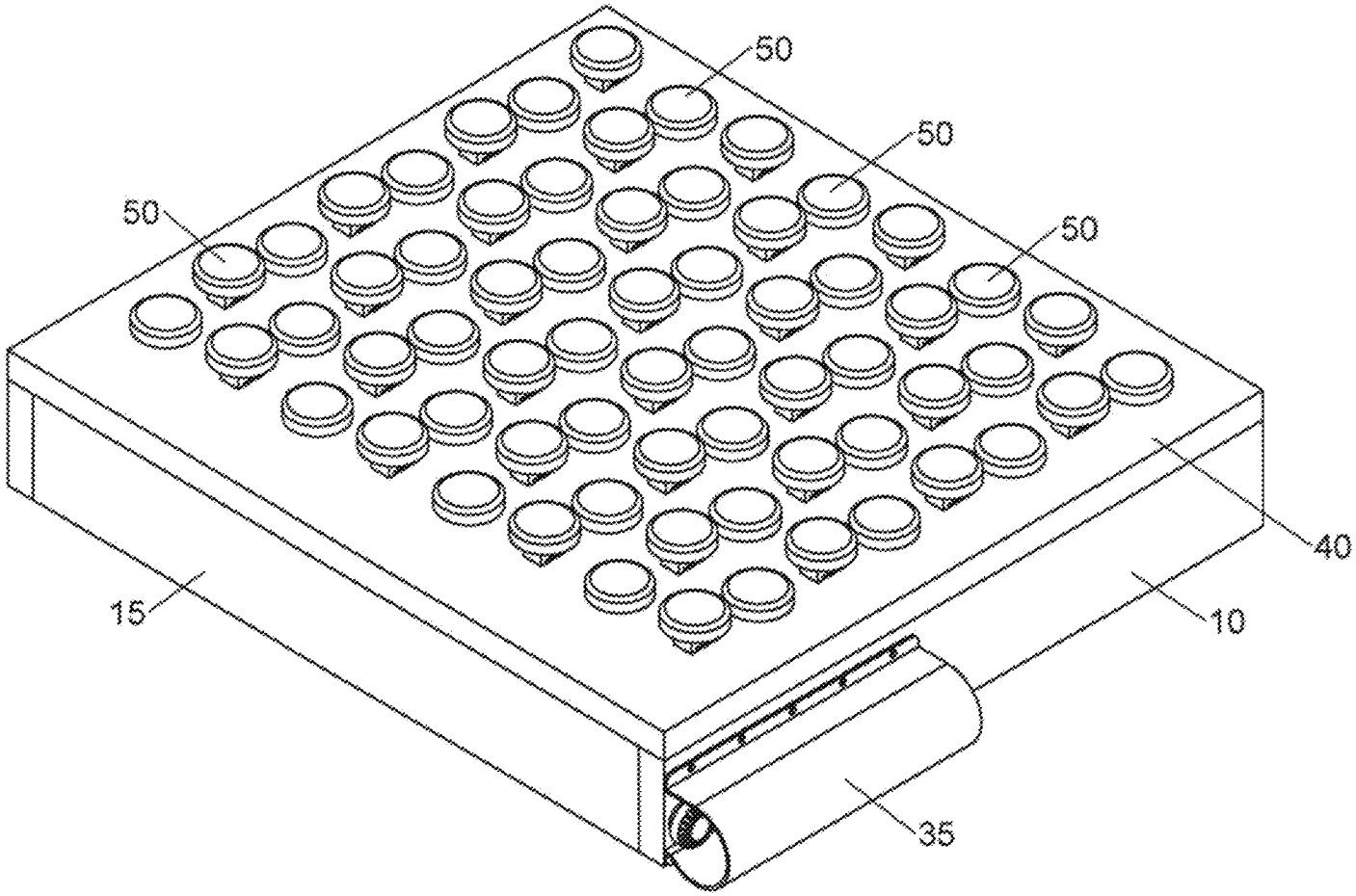
FIG. 10 is a perspective assembly view of the mat transmission structure in accordance with the preferred embodiment of the present invention.

Referring to FIGS. 8-10 with reference to FIGS. 1-7, the first operation units 20 are pivotally mounted in the first recess 11. The power unit 30 is assembled with the first body 10 and the first operation units 20. The power mechanism 33 in turn drives and rotates the third driving member 34 which drives and rotates the second driving member 32 which drives and rotates the drive shaft 31, and the drive portion 311 drives and rotates the first driving member 23 of each of the first operation units 20 such that each of the first operation units 20 is rotated. The second body 40 covers the top of the first body 10. The second operation units 50 are assembled with the first operation units 20 and the second body 40. The second operation member 51 of each of the second operation units 50 is received in each of the first receiving portions 41 and the third recess 42 of the second body 40. The second surface 511 of the second operation member 51 protrudes from the second body 40. The fourth driving member 52 is received in the second receiving portion 513 of the second operation member 51. The fourth driving member 52 extends into the third recess 42 of the second body 40 and presses the first surface 221 of each of the first operation units 20. The power unit 30 drives and rotates each of the first operation units 20, and each of the first operation units 20 drives the fourth driving member 52 and the second receiving portion 513 of each of the second operation units 50 to move upward and downward in each of the first receiving portions 41, such that the second surface 511 of the second operation member 51 is moved upward and downward.

As shown in FIGS. 8 and 9, the closure board 15 and the second body 40 are removed.

Figure 11:
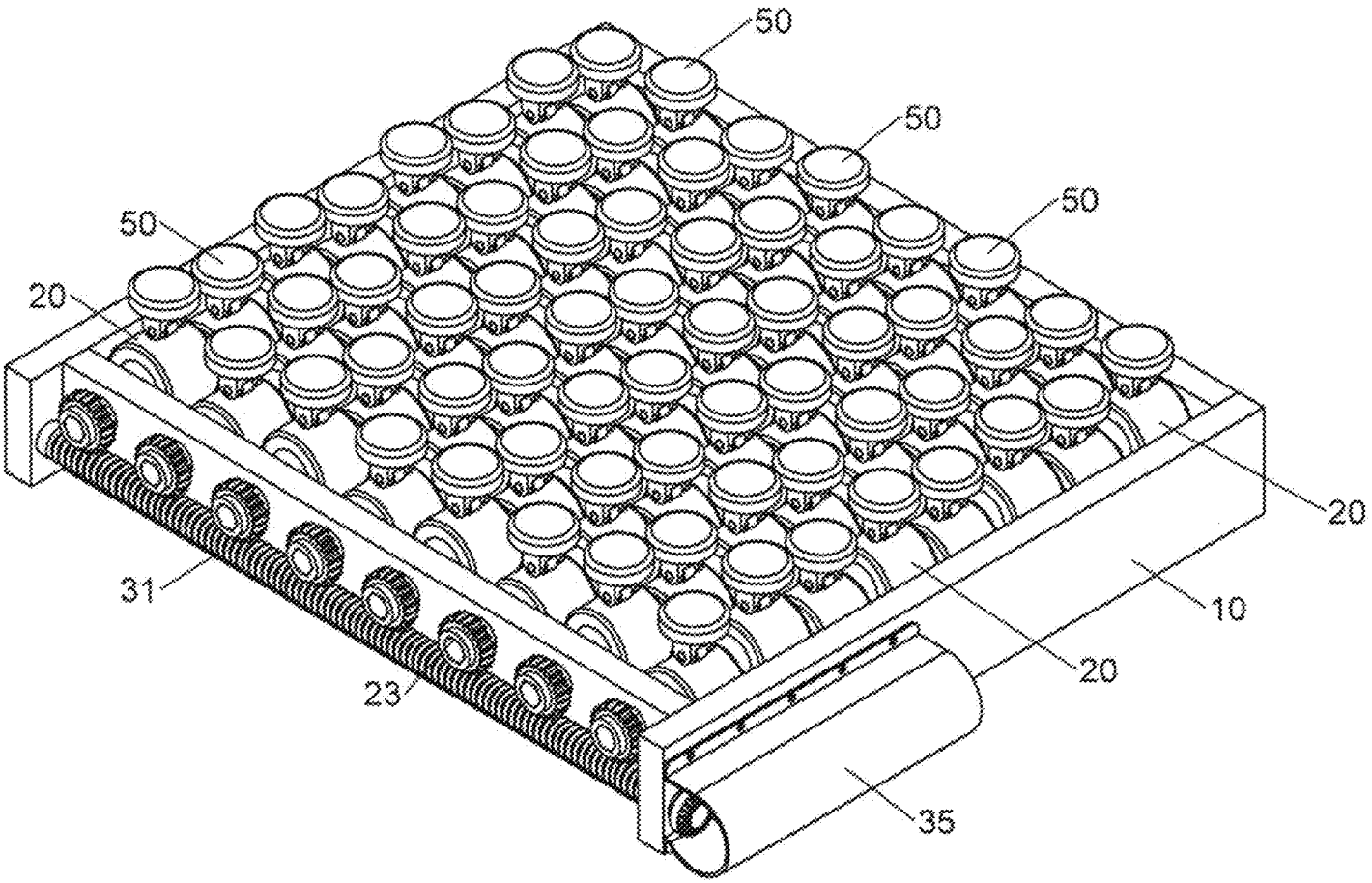
FIG. 11 is a perspective view showing operation of the mat transmission structure in accordance with the preferred embodiment of the present invention.

Referring to FIG. 11 with reference to FIG. 8, when the first operation units 20 are rotated, the first operation units 20 drive the second operation units 50 to move upward and downward.

Figure 12:
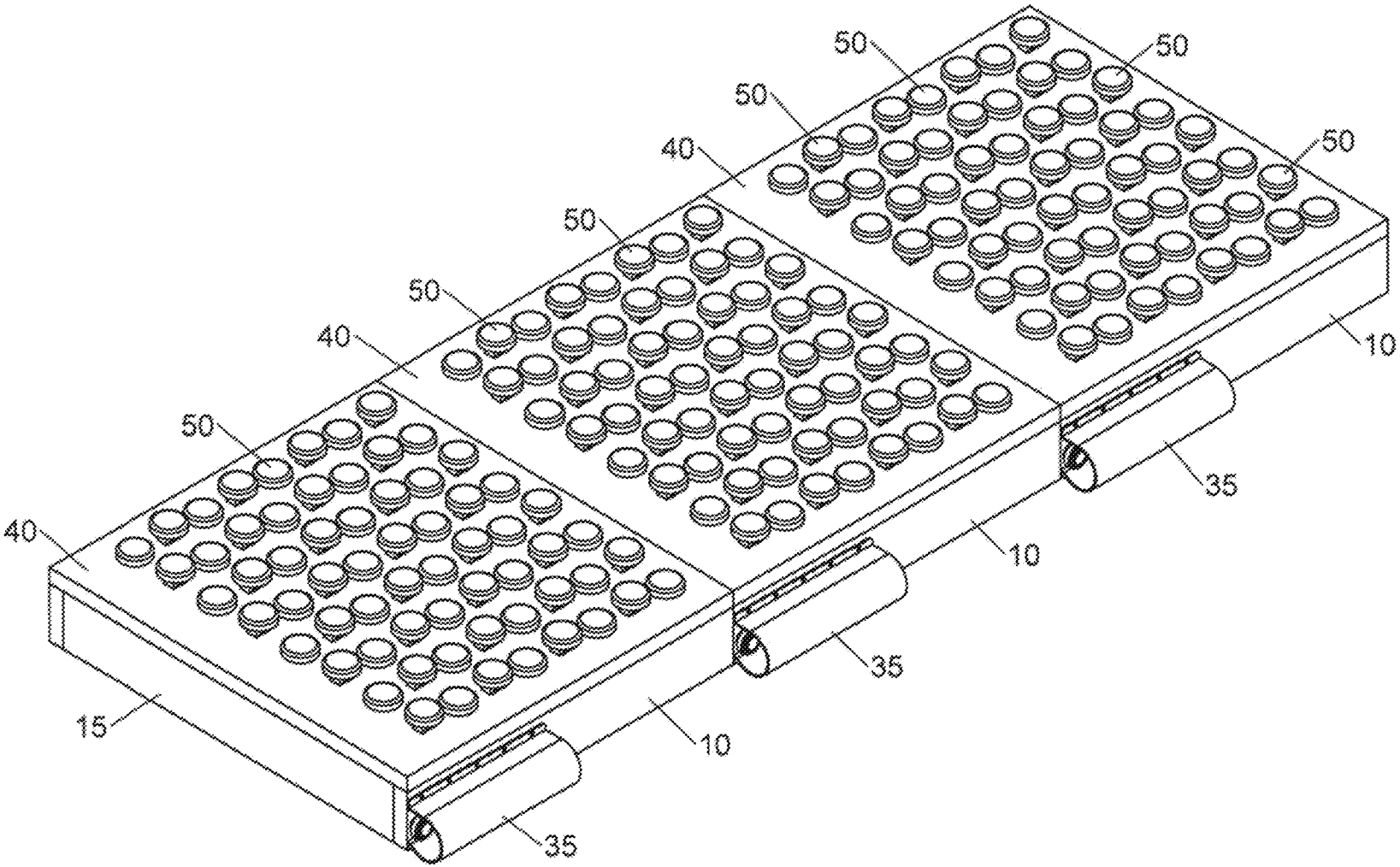
FIG. 12 is a perspective view of a mat transmission structure in accordance with the second preferred embodiment of the present invention.

Referring to FIG. 12, multiple mat transmission structures are provided and arranged linearly.

Figure 13:
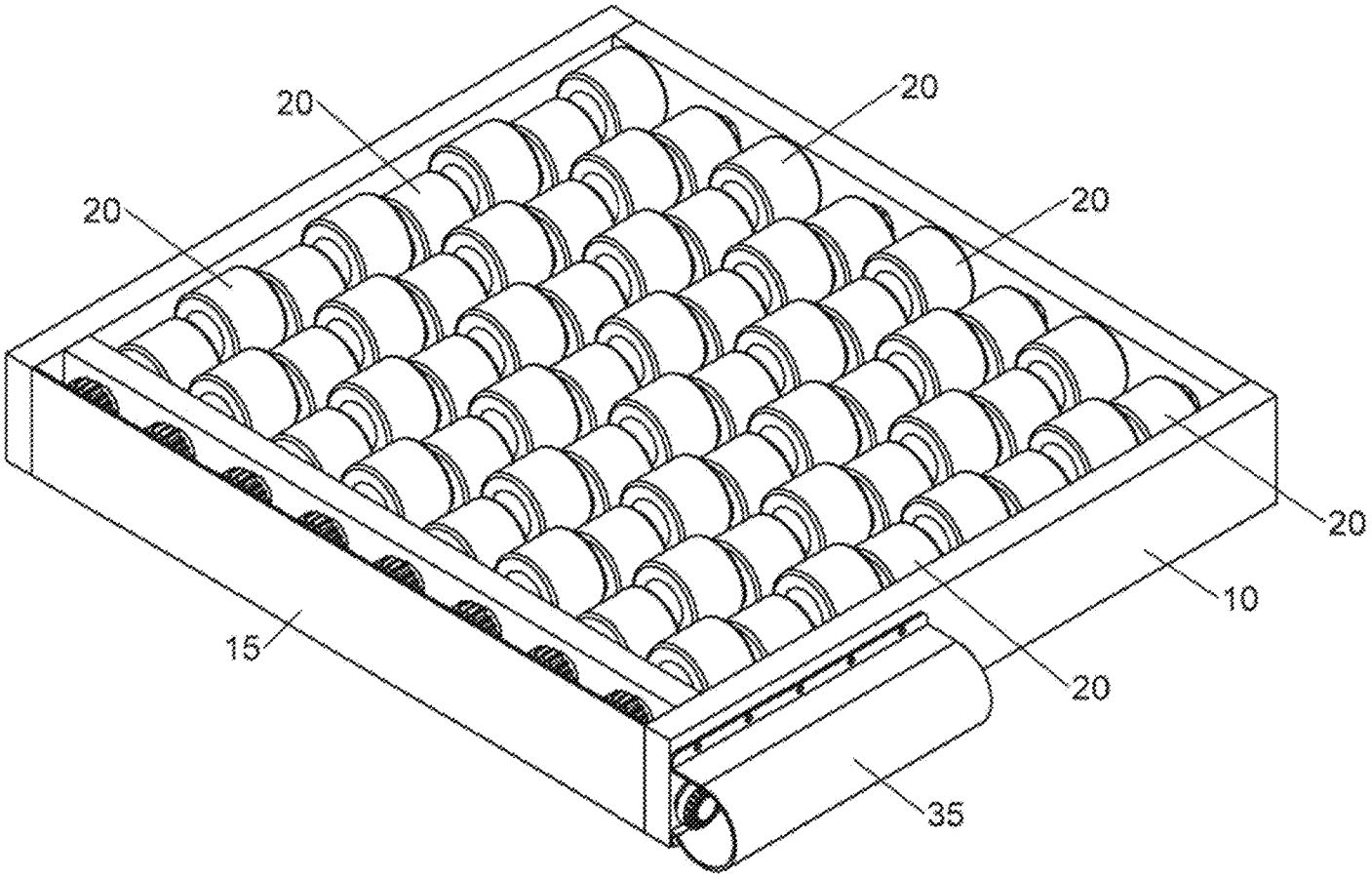
FIG. 13 is a perspective view of a mat transmission structure in accordance with the third preferred embodiment of the present invention.

Referring to FIG. 13, the second body 40 and the second operation units 50 are undefined. Thus, when the use's body rests on the first surface 221 of each of the first operation members 22 of each of the first operation units 20, the power unit 30 drives and rotates each of the first operation units 20, such that the first surface 221 of each of the first operation members 22 is driven and moved upward and downward to provide a massaging effect to the user.

Figure 14:
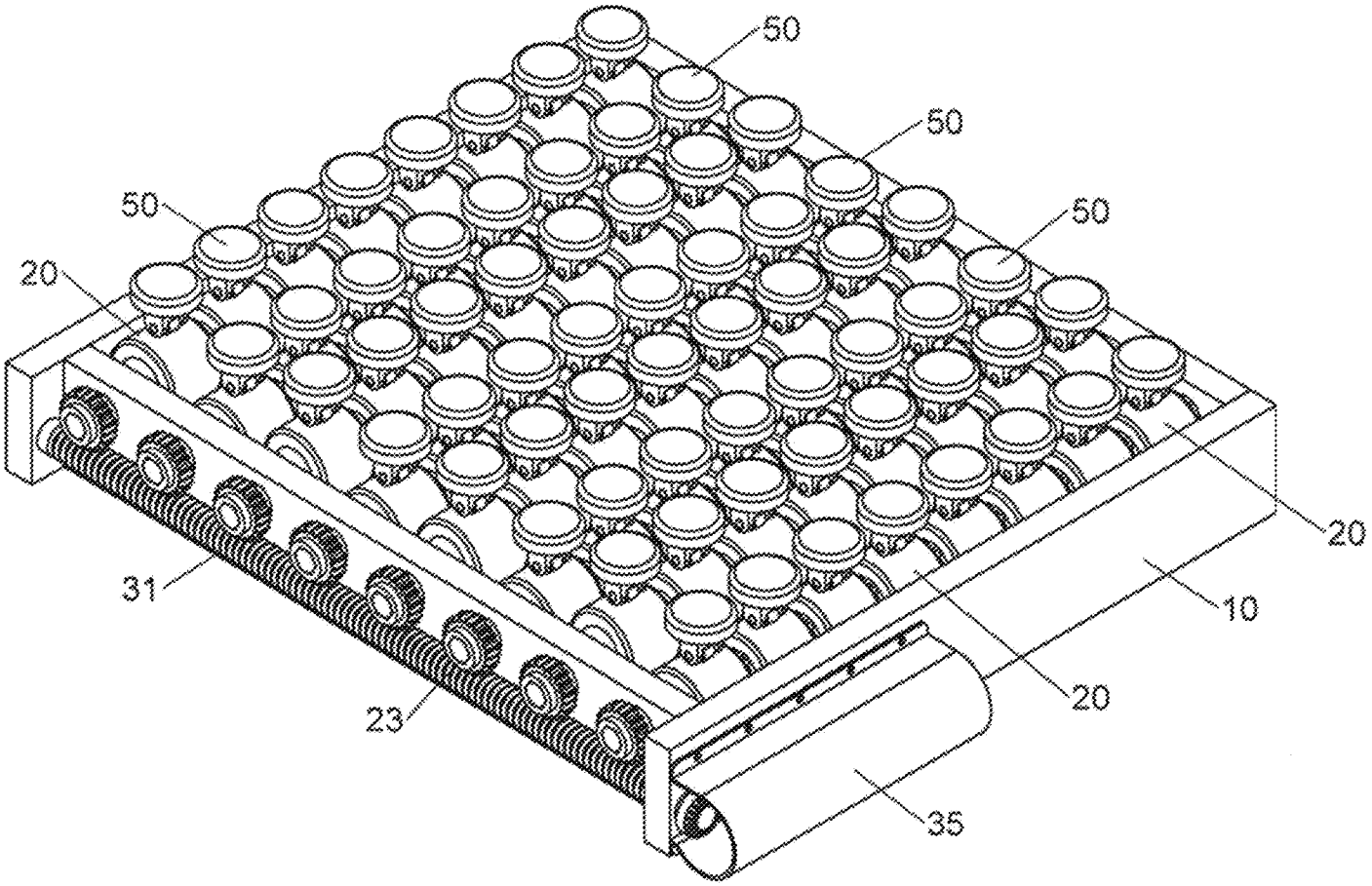
FIG. 14 is a perspective view of a mat transmission structure in accordance with the fourth preferred embodiment of the present invention.
Figure 15:
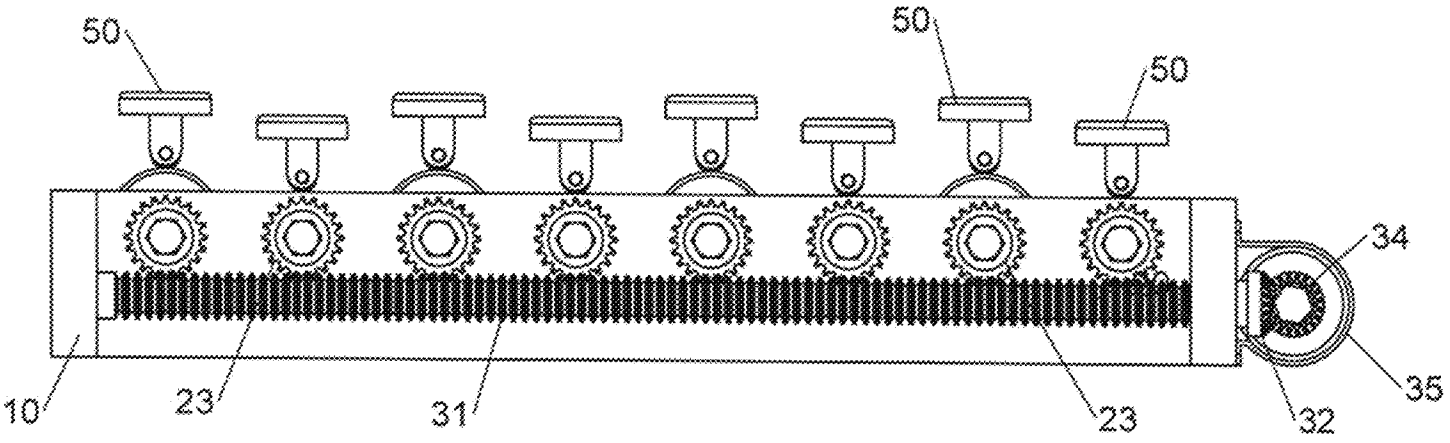
FIG. 15 is a front view of the mat transmission structure as shown in FIG. 14.

Referring to FIGS. 14 and 15, the first operation members 22 of each of the first operation units 20 are mounted at the same angle such that the first surfaces 221 of the first operation members 22 are flush with each other. In addition, the first operation members 22 of one of the first operation units 20 and the first operation members 22 of another one of the first operation units 20 are mounted at different angles such that the first surface 221 of one of the first operation units 20 is not flush with the first surface 221 of another one of the first operation units 20.

Figure 16:
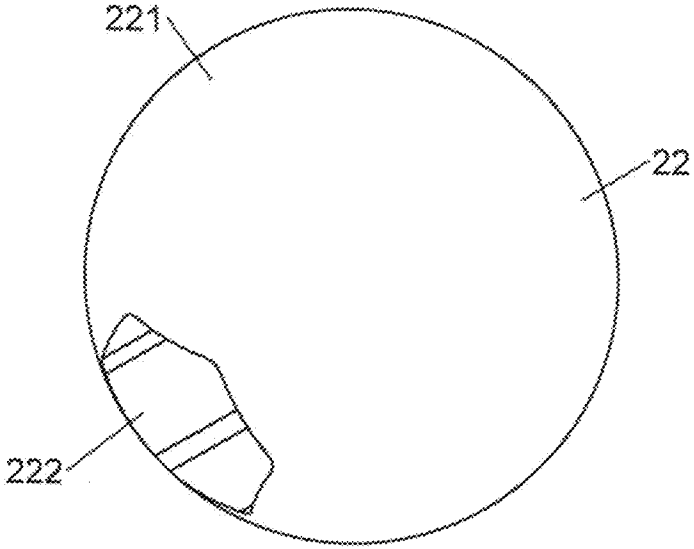
FIG. 16 is a front view of a first operation member of the first operation unit in accordance with the fifth preferred embodiment of the present invention.

Referring to FIG. 16, each of the first operation members 22 has a spherical shape. Alternatively, each of the first operation members 22 has a polygon shape, such as octagon, 12-gon (dodecagon), 14-gon (tetradecagon), or 16-gon (hexadecagon).

Figure 17:
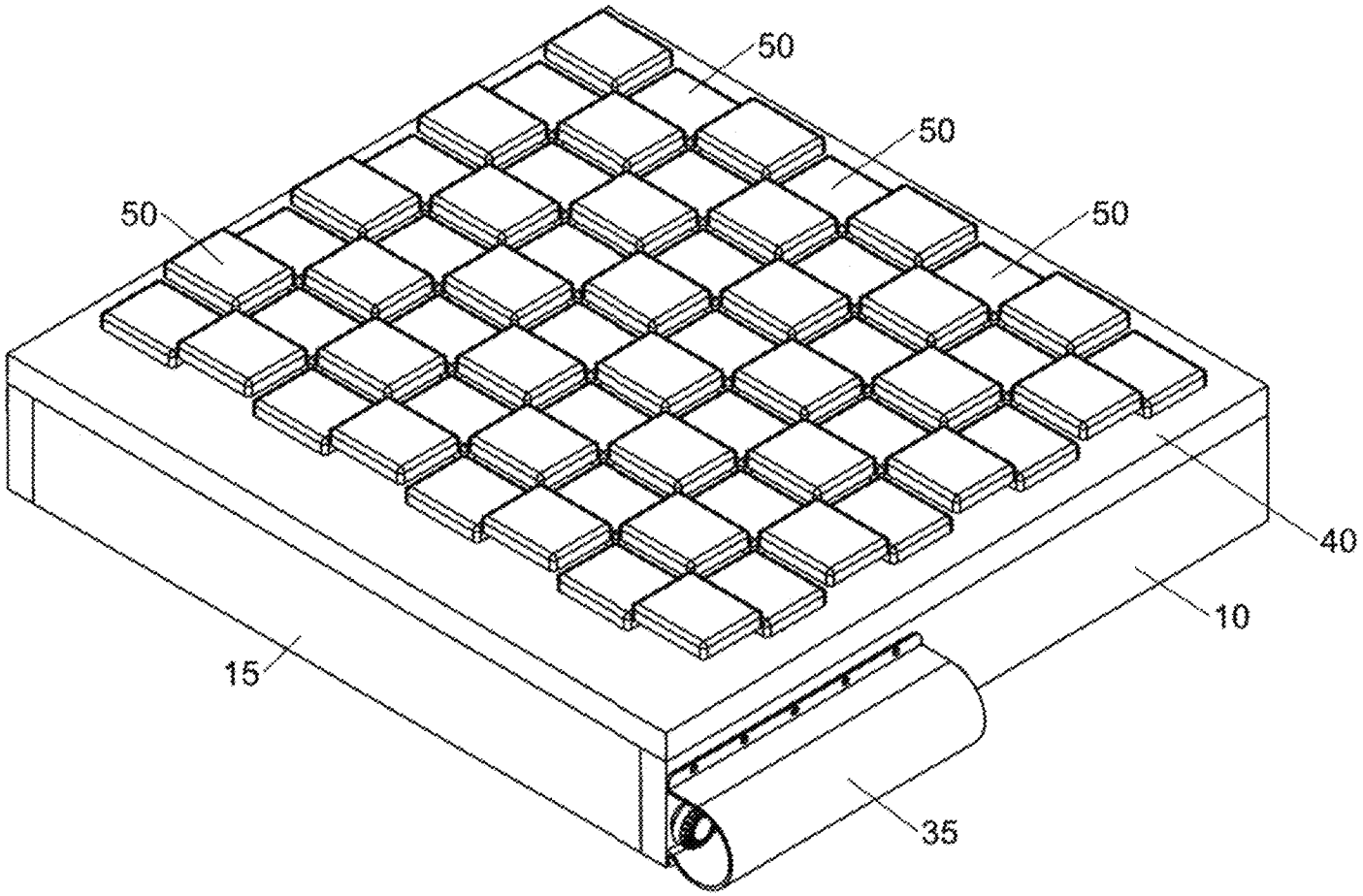
FIG. 17 is a perspective view of a mat transmission structure in accordance with the sixth preferred embodiment of the present invention.

Referring to FIG. 17, the second operation member 51 of each of the second operation units 50 has a cube or cuboid shape.

Figure 18:
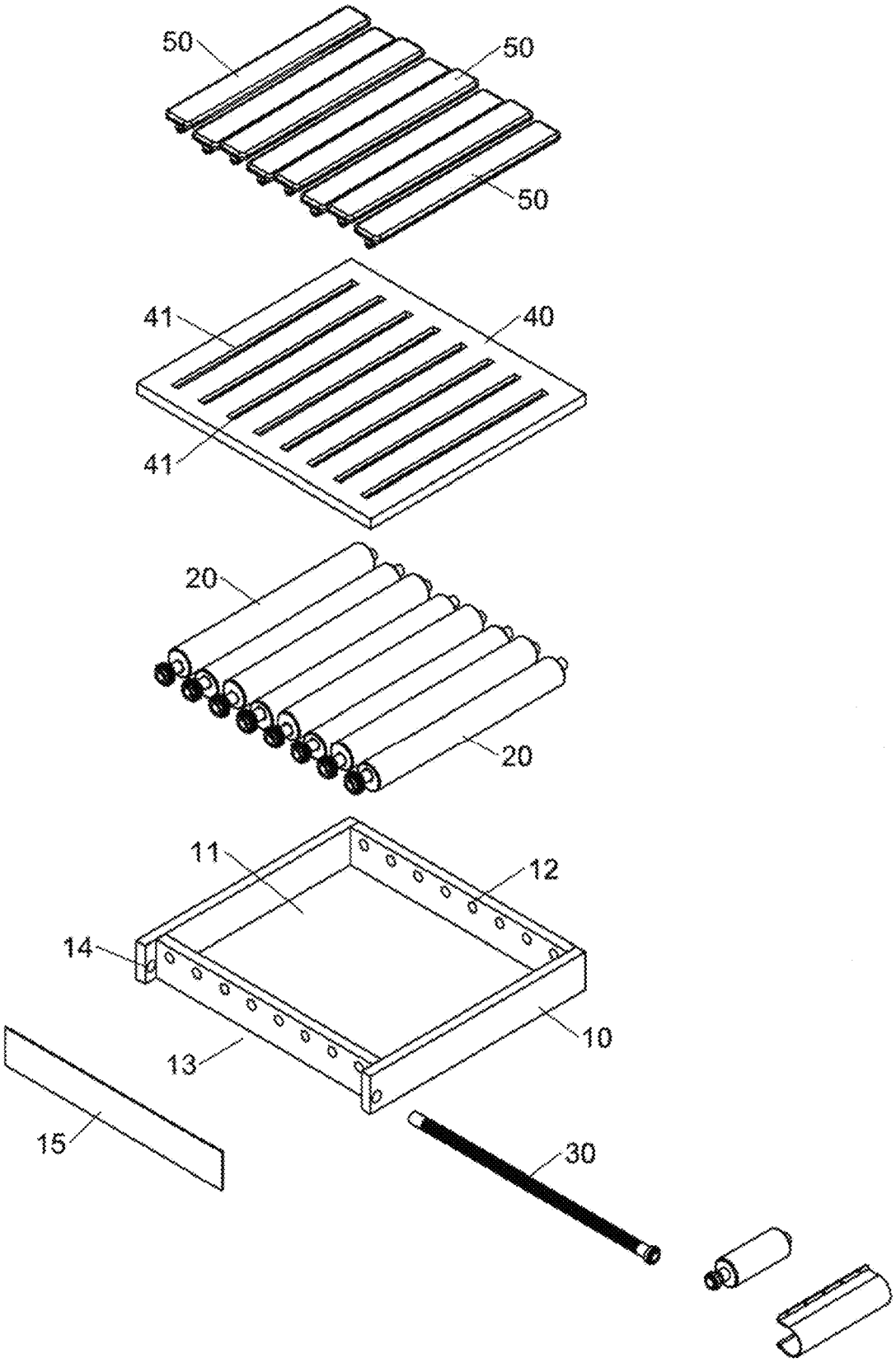
FIG. 18 is an exploded perspective view of a mat transmission structure in accordance with the seventh preferred embodiment of the present invention.
Figure 19:
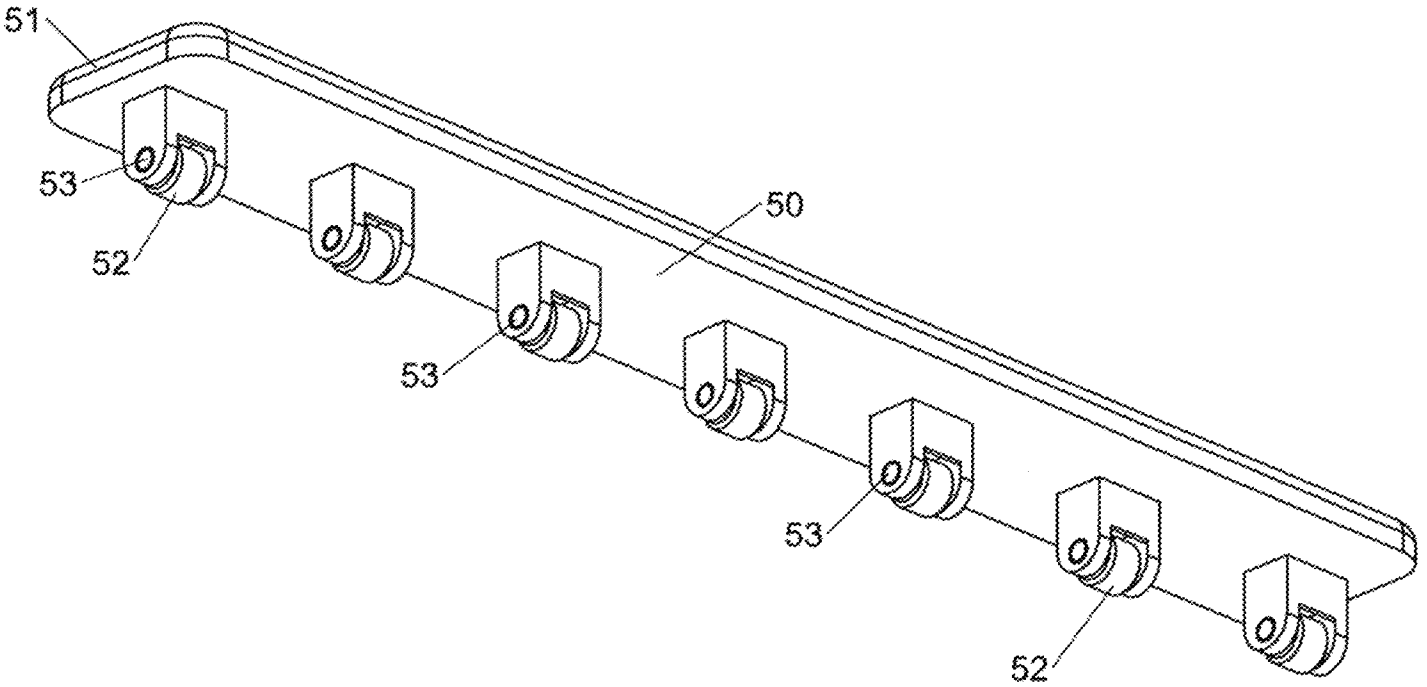
FIG. 19 is a perspective view of a second operation unit of the mat transmission structure in accordance with the seventh preferred embodiment of the present invention.

Referring to FIGS. 18 and 19, each of the first operation units 20 includes an elongate first operation member 22, the second body 40 is provided with a plurality of elongate first receiving portions 41, and each of the second operation units 50 includes an elongate second operation member 51.

In another embodiment of the present invention, each of the first operation units 20 further includes a plurality of spacers arranged between any two of the first operation members 22 such that the first operation members 22 are equally distant from each other. The first surface 221 is coated with a soft layer or each of the first operation members 22 is made of soft material. The second surface 511 is coated with a soft layer or the second operation member 51 is made of soft material.

In another embodiment of the present invention, the drive shaft 31 and the second driving member 32 of the power unit 30 are undefined, and a chain is mounted between the third driving member 34 and the first driving member 23 such that the third driving member 34 and the first driving member 23 are driven by the chain. Alternatively, a toothed rack is provided and engage the first driving member 23 of each of the first operation units 20. When the toothed rack is moved linearly and reciprocatingly, the first driving member 23 is driven and rotated through an angle in the clockwise or anticlockwise direction such that each of the first operation units 20 is rotated through an angle. Alternatively, the first driving members 23 of the first operation units 20 engage each other, and the power unit 30 drives and rotates one of the first driving members 23.

In another embodiment of the present invention, the length of the first body 10 and the rod 21 is substantially equal to that of a bed, such that the mat transmission structure functions as a bed.

Accordingly, the mat transmission structure has the following advantages.

1. The mat transmission structure is placed on any plane. Thus, when any part of the user's body rests on the mat transmission structure, the mat transmission structure provides a patting and massaging effect to the user. The mat transmission structure is expandable, and multiple mat transmission structures are provided and arranged linearly to provide a massaging effect to more parts of the user's body.

2. The mat transmission structure is placed on any plane. Thus, when any part of the user's body rests on the first surfaces 221 of the first operation units 20, the power unit 30 is driven to drive and rotate the first operation units 20 which drive the first surfaces 221 to pat and massage the user.

3. The mat transmission structure is placed on any plane. Thus, when any part of the user's body rests on the second surface 511 of each of the second operation units 50, the power unit 30 is driven to drive and rotate the first operation units 20 which simultaneously drive the fourth driving member 52 and the second receiving portion 513 of each of the second operation units 50 to move upward and downward in each of the first receiving portions 41, such that the second surface 511 of the second operation member 51 is moved upward and downward to pat and massage the user.

4. The eccentric construction is defined between the second fitting portion 222 and each of the first operation members 22, such that the first surface 221 of each of the first operation members 22 has a height variation when the rod 21 and the first operation members 22 are rotated. Thus, the first operation members 22 of each of the first operation units 20 are mounted at the same angle or at different angles such that when each of the first operation units 20 is rotated, the first surfaces 221 of the first operation units 20 are flush or not flush with each other. In such a manner, the second surfaces 511 of the second operation units 50 are driven by the first operation units 20 and in turn moved to press and massage the user's body.

5. Each of the first operation units 20 only includes the rod 21, the first operation members 22, and the first driving member 23, such that each of the first operation units 20 has a simplified construction, and each of the first operation members 22 has a height variation.

6. The mat transmission structure presents a cubic or cuboid seat with a flat shape after assembly to facilitate storage, transportation and packaging of the mat transmission structure.

7. The power mechanism 33 drives the third driving member 34 which drives the second driving member 32 which drives the drive shaft 31, and the drive portion 311 drives the first driving member 23 of each of the first operation units 20 such that each of the first operation units 20 is rotated.

8. The fourth driving member 52 presses the first surface 221 each of the first operation members 22. The power unit 30 drives and rotates each of the first operation units 20, and each of the first operation units 20 drives the fourth driving member 52 and the second receiving portion 513 of each of the second operation units 50 to move upward and downward in each of the first receiving portions 41, such that the second surface 511 of the second operation member 51 is moved upward and downward. The fourth driving member 52 of each of the second operation units 50 is rotated relative to each of the first operation members 22 to enhance the lifetime thereof.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A mat transmission system comprising:

at least one mat transmission structure, each of the at least one mat transmission structure comprising: a first body, a closure board, a plurality of first operation units, a power unit, a second body, and a plurality of second operation units;

wherein:

the first body is provided with a first recess;

the first recess is provided with a plurality of first pivot portions which are connected to the first recess;

the first body has a side provided with a second recess connected to the first pivot portions;

the second recess is provided with a second pivot portion which is connected to the second recess;

the second pivot portion has an axis perpendicular to that of each of the first pivot portions;

the closure board closes a side of the second recess;

the closure board aligns with the first pivot portions;

the first operation units are pivotally mounted in the first recess;

each of the first operation units is pivotally mounted on each of the first pivot portions, and rotated about an axis thereof;

the first operation units are arranged linearly, and rotated simultaneously in the first recess;

each of the first operation units includes a rod, a plurality of first operation members, and a first driving member;

the rod is mounted pivotally on each of the first pivot portions;

the rod has a length corresponding to that of the first body;

the rod is provided with a first fitting portion;

the first fitting portion has two ends each provided with a first pivoting section;

the first pivoting section is pivotally mounted on each of the first pivot portions;

the rod is provided with a first mounting portion;

the first mounting portion extends into the second recess;

each of the first pivot portions is arranged between the first fitting portion and the first mounting portion;

the first operation members are mounted on the rod and received in the first recess;

the first operation members are arranged linearly on the rod;

when the rod is rotated, the first operation members are rotated in concert with the rod;

each of the first operation members has a periphery provided with a first surface;

each of the first operation members is provided with a second fitting portion fitted on the first fitting portion;

an eccentric construction is defined between the second fitting portion and each of the first operation members, such that the first surface of each of the first operation members has a height variation when the rod and the first operation members are rotated;

the first surface partially protrudes from a top of the first body during rotation of each of the first operation members;

the first driving member is mounted on the first mounting portion and received in the second recess of the first body;

the power unit is assembled with the first body;

the power unit drives the first driving member of each of the first operation units;

the power unit includes a drive shaft, a second driving member, a power mechanism, and a third driving member;

the drive shaft is received in the second recess and provided with a drive portion engaging the first driving member;

the drive portion is an external thread and has two ends each provided with a second pivoting section;

the second pivoting section is pivotally mounted on the second pivot portion;

the drive shaft is provided with a second mounting portion;

the second mounting portion protrudes from the first body;

the second driving member is mounted on the second mounting portion and protrudes from the first body;

the power mechanism is arranged at a side of the second driving member and protrudes from the first body;

the power mechanism includes a motor and a speed reduction unit;

the third driving member is mounted on the power mechanism and engages the second driving member;

the power mechanism drives the third driving member which drives the second driving member which drives the drive shaft, and the drive portion drives the first driving member of each of the first operation units;

the second body is mounted on the top of the first body and closes the first recess, such that the first operation units are hidden in the first body and the second body;

the second body is provided with a plurality of first receiving portions;

each of the first receiving portions aligns with the first surface of each of the first operation members;

the second body is provided with a third recess aligning with the first recess and receiving the first operation members;

the third recess is connected to each of the first receiving portions;

the second operation units are assembled with the first operation units and the second body;

each of the second operation units is mounted on each of the first receiving portions;

the first operation units are rotated and drive the second operation units to move upward and downward;

each of the second operation units includes a second operation member, a fourth driving member, and a pivot pin;

the second operation member is received in each of the first receiving portions and has a first end provided with a second surface and a second end provided with a second receiving portion;

the second surface protrudes from the second body;

the second receiving portion is received in each of the first receiving portions and extends into the third recess;

the second receiving portion is provided with a first pivot hole;

the first pivot hole is hidden in the second body;

the fourth driving member is mounted in the second receiving portion and presses the first surface;

a pivot construction is defined between the fourth driving member and the second operation member;

the power unit drives each of the first operation units, and each of the first operation units drives the fourth driving member and the second receiving portion to move upward and downward in each of the first receiving portions, such that the second surface is moved upward and downward;

the fourth driving member is provided with a second pivot hole;

the second pivot hole aligns with the first pivot hole;

the pivot pin is pivotally mounted in the first pivot hole and the second pivot hole, such that the fourth driving member and the second operation member are connected pivotally; and the fourth driving member is rotated about the pivot pin, and is rotated relative to each of the first operation members in the second receiving portion.

2. The mat transmission system as claimed in claim 1, wherein the first fitting portion has a noncircular or hexagonal shape, the first pivoting section has a circular shape, the first mounting portion has a noncircular or hexagonal shape, the second fitting portion has a shape corresponding to that of the first fitting portion, and the second fitting portion is a hexagonal groove.

3. The mat transmission system as claimed in claim 1, wherein:

each of the first operation members has a cylindrical shape;

the first body is a quadrilateral frame assembled by a plurality of boards;

the first recess has a quadrilateral shape and has an open top and an open bottom;

the first pivot portions are arranged linearly and spaced from each other;

each of the first pivot portions is a circular perforation extending transversely through the first recess;

the second recess is open and has a rectangular shape;

the second pivot portion is a circular perforation extending longitudinally through the second recess;

the third recess has a quadrilateral shape;

the first pivot hole has a circular shape and extends transversely through the second receiving portion;

the fourth driving member has a cylindrical shape; and the pivot pin is a circular rod.

4. The mat transmission system as claimed in claim 1, wherein:

the first operation members of each of the first operation units are mounted at different angles such that the first surfaces of the first operation members are not flush with each other, or mounted at the same angle such that the first surfaces of the first operation members are flush with each other; and the first operation members of one of the first operation units and the first operation members of another one of the first operation units are mounted at different angles such that the first surface of one of the first operation units is not flush with the first surface of another one of the first operation units.

5. The mat transmission system as claimed in claim 1, wherein the first driving member is a gear.

6. The mat transmission system as claimed in claim 1, wherein the second pivoting section has a circular shape, the second mounting portion has a noncircular or hexagonal shape, the second driving member is a gear, and the third driving member is a gear.

7. The mat transmission system as claimed in claim 1, wherein:

the power unit further includes a cover mounted on the first body and having a C-shaped configuration; and the second mounting portion, the second driving member, the power mechanism, and the third driving member are hidden in the cover.

8. The mat transmission system as claimed in claim 1, wherein each of the first receiving portions is a quadrilateral groove.

9. The mat transmission system as claimed in claim 1, wherein wherein the at least one mat transmission structure comprises multiple mat transmission structures, wherein the multiple mat transmission structures are provided and arranged linearly.

10. The mat transmission system as claimed in claim 1, wherein each of the first operation members has a spherical shape or a polygonal shape.

11. The mat transmission system as claimed in claim 1, wherein each of the first operation units further includes a plurality of spacers arranged between any two of the first operation members.

12. The mat transmission system as claimed in claim 1, wherein: the first surface is coated with a soft layer or each of the first operation members is made of soft material; and the second surface is coated with a soft layer or the second operation member is made of soft material.

13. The mat transmission system as claimed in claim 1, wherein: a chain is mounted between the third driving member and the first driving member such that the third driving member and the first driving member are driven by the chain;

a toothed rack is provided and engage the first driving member of each of the first operation units;

when the toothed rack is moved linearly and reciprocatingly, the first driving member is driven and rotated through an angle such that each of the first operation units is rotated through an angle;

the first driving members of the first operation units engage each other; and the power unit drives one of the first driving members.

* * * * *